US011230814B2

(12) United States Patent
Stadler et al.

(10) Patent No.: US 11,230,814 B2
(45) Date of Patent: Jan. 25, 2022

(54) TRACK MAINTENANCE WAGON FOR PICKING UP AND/OR LAYING TRACK PANELS

(71) Applicant: Plasser & Theurer Export von Bahnbaumaschinen Gesellschaft m.b.H., Vienna (AT)

(72) Inventors: Lothar Stadler, Vienna (AT); Gerard Lintz, Bening-les-Saint-Avold (FR)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 408 days.

(21) Appl. No.: 16/314,755

(22) PCT Filed: Jul. 6, 2017

(86) PCT No.: PCT/EP2017/000797
§ 371 (c)(1),
(2) Date: Jan. 2, 2019

(87) PCT Pub. No.: WO2018/024353
PCT Pub. Date: Feb. 8, 2018

(65) Prior Publication Data

US 2019/0153677 A1 May 23, 2019

(30) Foreign Application Priority Data

Aug. 3, 2016 (AT) ..... GM 195/2016

(51) Int. Cl.
*E01B 29/02* (2006.01)

(52) U.S. Cl.
CPC ..... *E01B 29/02* (2013.01)

(58) Field of Classification Search
CPC ..... E01B 29/00; E01B 29/02; E01B 29/04; E01B 29/05; E01B 29/06; E01B 31/00; E01B 31/02; E01B 33/00
See application file for complete search history.

(56) References Cited

U.S. PATENT DOCUMENTS 5,400,718 A 3/1995 Theurer et al.
5,657,888 A 8/1997 Kröll et al.
5,921,415 A * 7/1999 Markelz ..... B66C 17/00 212/294

FOREIGN PATENT DOCUMENTS

AT 324388 B 8/1975
CN 1088531 A 6/1994
(Continued)

OTHER PUBLICATIONS

Chinese Office Action in Chinese Application No. 201780047854.7, dated Apr. 3, 2020.
(Continued)

*Primary Examiner* — Robert J McCarry, Jr.
(74) *Attorney, Agent, or Firm* — Collard & Roe, P.C.

(57) ABSTRACT

A track maintenance wagon (1) for picking up and/or laying a track panel (10), comprising a wagon frame (2) supported on on-track undercarriages (4), wherein two longitudinal beams (7) of the wagon frame (2) delimit a free opening and are transversely displaceable relative to one another, so that the free opening is changeable as to its width and, in a working position, has greater opening dimensions as a horizontal projection of the track panel (19), and wherein crane rails (8) are arranged on the longitudinal beams (7) for a gantry crane (11) mobile in the longitudinal direction (3) of the wagon. In this, buffers (13) are arranged at two free ends (12) of the longitudinal beams (7).

6 Claims, 1 Drawing Sheet

(56) References Cited

FOREIGN PATENT DOCUMENTS

| | | | | | |
|---|---|---|---|---|---|
| CN | 201240382 | Y | | 5/2009 | |
| DE | 196 07 958 | A1 | | 9/1997 | |
| DE | 102006024069 | A1 | * | 11/2007 | ..... F16K 31/04 |
| DE | 20 2009 017 410 | U1 | | 3/2010 | |
| EP | 0486456 | A1 | | 5/1992 | |
| FR | 2 645 185 | A1 | | 10/1990 | |

OTHER PUBLICATIONS

International Search Report of PCT/EP2017/000797, dated Sep. 28, 2017.
Austrian Search Report in Austrian Application No. GM 195/2016 dated Aug. 3, 2016.
Chinese Office Action in Chinese Application No. 201780047854.7, dated Apr. 3, 2020 with English translation.

* cited by examiner

TRACK MAINTENANCE WAGON FOR PICKING UP AND/OR LAYING TRACK PANELS

CROSS REFERENCE TO RELATED APPLICATIONS

This application is the National Stage of PCT/EP2017/000797 filed on Jul. 6, 2017, which claims priority under 35 U.S.C. §119; of Austrian Application No. GM 195/2016 filed on Aug. 3, 2016, the disclosures of which are incorporated by reference. The international application under PCT article 21(2) was not published in English.

FIELD OF TECHNOLOGY

The invention relates to a track maintenance wagon for picking up and/or laying a track panel, comprising a wagon frame supported on on-track undercarriages, wherein two longitudinal beams of the wagon frame delimit a free opening and are transversely displaceable relative to one another, so that the free opening is changeable as to its width and, in a working position, has greater opening dimensions as a horizontal projection of the track panel, and wherein crane rails are arranged at the longitudinal beams for a gantry crane mobile in the longitudinal direction of the wagon.

PRIOR ART

In known track renewal methods, several track maintenance wagons in a train formation serve for exchanging track sections by means of a gantry crane.

In AT 324 388 B, for example, track maintenance wagons having adjustable wagon frames are employed. The particular wagon frame comprises a transverse displacement device by means of which two longitudinal beams are transversely displaceable relative to transverse beams resting on on-track undercarriages. With this, an opening between the longitudinal beams is widened in order to enable the picking up or laying down of track panels.

In this known solution, buffer and draw gears are arranged on the transverse beams. When transmitting pulling- and pushing forces from one track maintenance wagon to the adjacent wagon in a train formation, this causes undesirable shear forces and moments at guides and drives of the transverse displacement devices.

SUMMARY OF THE INVENTION

It is the object of the invention to provide an improvement over the prior art for a track maintenance wagon of the type mentioned at the beginning.

According to the invention, this object is achieved with a track maintenance wagon according to claim 1. Dependent claims relate to advantageous embodiments of the invention.

The invention provides that buffers are arranged at two free ends of the longitudinal beams. This has the advantage that, in a train formation, no shear forces are transmitted to the transverse displacement device. Thus, a drive for transverse displacement can be sized with correspondingly small dimensions.

In an advantageous further development of the invention, it is provided that draw gears are arranged at the free ends of the longitudinal beams. With this, no shear forces act upon the transverse displacement device also in the event of transmitting pulling forces in a train formation.

In this, it is favourable if the draw gears are designed as rail bridges for the crane rails. Thus, besides the transmission of the pulling forces in the train formation with length compensation for travel in curves, the crane rail gaps between the track maintenance wagons are also bridged.

A further advantageous detail of the invention is that the drive for the transverse displacement device is configured hydraulically. This results in optimal structural adaptation to space conditions and an even motion of the longitudinal beams to be displaced.

Alternatively, it can also be advantageous if the respective transverse displacement device is provided with an electrical drive. With this, a hydraulic system is no longer necessary.

It is also advantageous to provide the transverse displacement device with a spindle drive. This results not only in the transverse displacement devices being exactly parallel, but also in high precision of adjustment.

Additional advantages of the invention become apparent from the drawing description.

BRIEF DESCRIPTION OF THE DRAWINGS

The invention will be described by way of example below with reference to the attached figures. There is shown in schematic representation in.

DESCRIPTION OF THE EMBODIMENTS

Figures 1, 2, 3:
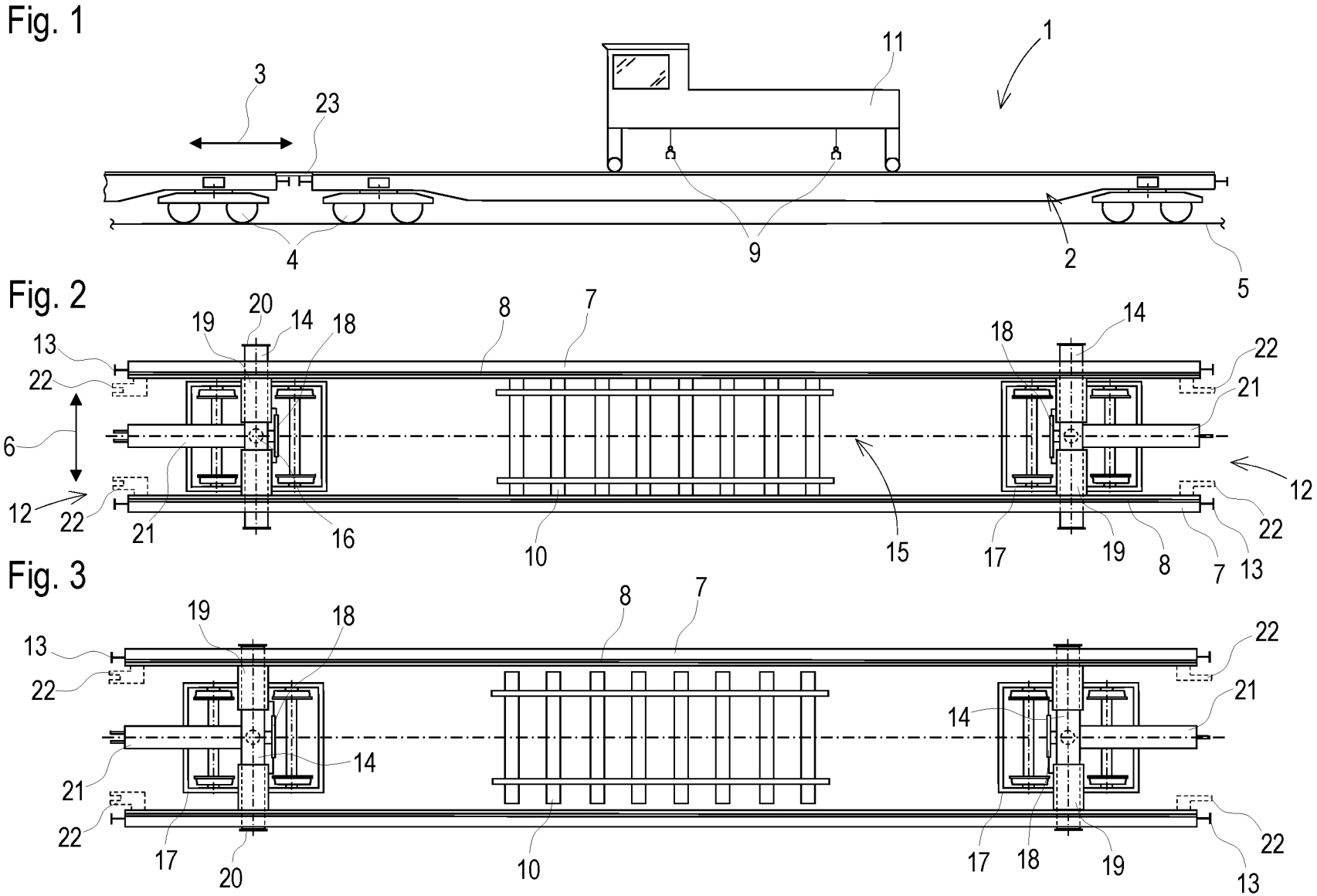
FIG. 1 a side view of track maintenance wagon with a gantry crane.
FIG. 2 top view of track maintenance wagon in transport position.
FIG. 3 top view of track maintenance wagon in working position.

A track maintenance wagon 1 visible in FIG. 1 has a beam-shaped wagon frame 2 which extends in a longitudinal direction 3 of the wagon and is supported at the ends on on-track undercarriages 4 and mobile by means of the same on a track 5. The wagon frame 2 has, on its longitudinal beams 7 which are displaceable in transverse direction 6 of the track, crane rails 8 for mobility of a gantry crane 11 equipped with gripping devices 9 for grasping track panels 10. Buffers 13 are arranged at the ends 12 of the longitudinal beams 7 which are free at both sides.

In FIG. 2, the track maintenance wagon 1 is shown in a transport position during transfer travel. To that end, the longitudinal beams 7 are displaced on transverse beams 14 in the direction towards a track center 15. The transverse beams 14, arranged transversely to the longitudinal beams 7, are arranged for rotation about a vertical axis 16 on the on-track undercarriages 4 designed as bogies 17. Arranged on the transverse beams 14 are transverse displacement devices 19 equipped with displacement drives 18 and guides. By means of the transverse displacement devices 19, the longitudinal beams 7 are transversely adjustable relative to each other.

Visible in FIG. 3 is a working position of the track maintenance wagon 1. In this position, the longitudinal beams 7 are displaced by means of the transverse displacement devices 19 in the direction towards a respective stop 20 of the transverse beams 14.

In a simple embodiment shown in FIGS. 2 and 3, draw hooks 21 are arranged centrally on the transverse beams 14.

Alternatively, in a variant of embodiment shown in dashed lines, pulling devices 22 are located next to the buffers 13 at the ends of the longitudinal beams 7, wherein a length compensation is to be provided for travel in curves.

Such pulling devices 22 can be designed in combined structure as rail bridges 23 for connection of the crane rails in the train formation.

The invention claimed is:

1. A track maintenance wagon for picking up and/or laying a track panel, comprising a wagon frame comprising two longitudinal beams;

a plurality of on-track undercarriages, wherein the wagon frame is supported on said on-track undercarriages, wherein said two longitudinal beams of the wagon frame delimit a free opening and are transversely displaceable relative to one another, so that the free opening is changeable as to its width and, in a working position, has greater opening dimensions as a horizontal projection of the track panel, and a plurality of crane rails arranged at the longitudinal beams for a gantry crane mobile in the longitudinal direction of the wagon, wherein buffers are arranged at two free ends of the longitudinal beams.

2. The track maintenance wagon according to claim 1, wherein draw gears are arranged at free ends of the longitudinal beams.

3. The track maintenance wagon according to claim 2, wherein the draw gears are designed as rail bridges for the crane rails.

4. The track maintenance wagon according to claim 1, wherein a displacement drive for a transverse displacement device is configured hydraulically.

5. The track maintenance wagon according to claim 1, wherein a displacement drive for a transverse displacement device is configured electrically.

6. The track maintenance wagon according to claim 4, wherein the displacement drive is configured as a spindle drive.

* * * * *